US008390198B2

(12) United States Patent
Shimizu et al.

(10) Patent No.: US 8,390,198 B2
(45) Date of Patent: Mar. 5, 2013

(54) DISCHARGE LAMP WITH AN IMPROVED CATHODE OF THE TYPE HAVING A THORIATED TUNGSTEN PART

(75) Inventors: Akihiro Shimizu, Himeji (JP); Tomoyoshi Arimoto, Himeji (JP); Mitsuru Ikeuchi, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/015,136

(22) Filed: Jan. 27, 2011

(65) Prior Publication Data

US 2011/0181181 A1 Jul. 28, 2011

(30) Foreign Application Priority Data

Jan. 28, 2010 (JP) ..... 2010-016369

(51) Int. Cl.
*H01J 17/04* (2012.01)
*H01J 17/20* (2012.01)

(52) U.S. Cl. ..... 313/638; 313/637; 313/567; 313/631; 313/632

(58) Field of Classification Search ..... None
See application file for complete search history.

(56) References Cited

U.S. PATENT DOCUMENTS

| | | | | |
|---|---|---|---|---|
| 2006/0220559 | A1* | 10/2006 | Ikeuchi | 313/633 |
| 2012/0001541 | A1* | 1/2012 | Ikeuchi et al. | 313/632 |
| 2012/0001542 | A1* | 1/2012 | Ikeuchi et al. | 313/633 |
| 2012/0081002 | A1* | 4/2012 | Arimoto et al. | 313/632 |
| 2012/0181925 | A1* | 7/2012 | Arimoto et al. | 313/633 |

FOREIGN PATENT DOCUMENTS

JP 42-27213 12/1942

* cited by examiner

*Primary Examiner* — Natalie Walford
(74) *Attorney, Agent, or Firm* — Roberts Mlotkowski Safran & Cole, P.C.; David S. Safran

(57) ABSTRACT

A discharge lamp with excellent arc stability and excellent durability in which the use level of thoriated tungsten is restrained has an anode and a cathode in the interior of a discharge vessel, wherein said cathode is made up from a thoriated tungsten part with a tungsten filling ratio of at least 90 vol.-% and a main body part connected to said thoriated tungsten part and consisting of pure tungsten, wherein a ratio $S_T/S$ of a side surface area $S_T$ of said thoriated tungsten part and a side surface area S of said cathode is in a range of from 0.005 to 0.15, with the proviso that, in case the cathode has a length in the direction of the cathode axis which exceeds twice the maximum diameter of the cathode, a side surface area S is used for calculating the ratio $S_T/S$ which corresponds to the side surface area where the distance along the cathode axis from a tip end adjacent to the anode is twice the maximum diameter of the cathode.

7 Claims, 3 Drawing Sheets

DISCHARGE LAMP WITH AN IMPROVED CATHODE OF THE TYPE HAVING A THORIATED TUNGSTEN PART

BACKGROUND OF THE INVENTION

1. Field of the Invention

The present invention relates to a discharge lamp, and relates particularly to a discharge lamp wherein thorium (Th) is used as the emitter in the cathode.

2. Description of Related Art

Traditionally, high-pressure mercury lamps are used for the light source in exposure machines for liquid crystals or semiconductors, while xenon lamps are used in the light source for projectors. It is necessary for these discharge lamps that the arc is stable during the lighting (arc stability) and that a constant irradiance can be maintained for a long time (durability). To meet these demands, a material with excellent ability to ignite the arc and excellent wear resistance becomes necessary for the electrodes, and in particular so-called thoriated tungsten ($ThO_2$—W) for which thorium oxide ($ThO_2$) has been doped into tungsten (W) has been used for the material of the cathode (JP-A-42-27213 (1967)).

But in recent years restrictions for the use of radioactive substances such as thorium arc are to be observed with regard to the environmental load, whereas the arc stability and the durability rightly have been necessary for discharge lamps.

SUMMARY OF THE INVENTION

The problem to be solved by this invention is to provide a discharge lamp with excellent arc stability and excellent durability in which the use level of thoriated tungsten is restrained.

To solve this above-mentioned problem, a discharge lamp according to this invention which is configured such that an anode and a cathode are present in the interior of a discharge vessel is characterized in that the cathode is made up from a thoriated tungsten part with a tungsten filling ratio of at least 90 vol.-% and a main body part connected to said thoriated tungsten part and consisting of pure tungsten, wherein a ratio $S_T/S$ of a side surface area $S_T$ of said thoriated tungsten part and a side surface area S of said cathode is in a range of from 0.005 to 0.15, with the proviso that, in case the cathode has a length in the direction of the cathode axis which exceeds twice the maximum diameter of the cathode, a side surface area S is used for calculating the ratio $S_T/S$ which corresponds to the side surface area where the distance along the cathode axis from a tip end adjacent to the anode is twice the maximum diameter of the cathode.

Further, the invention is characterized in that said thoriated tungsten part and said main body part are diffusion-bonded.

The discharge lamp according to the present invention can reduce the use of thoriated tungsten by employing a cathode with a ratio $S_T/S$ of the side surface $S_T$ of the thoriated tungsten part and the side surface S of the cathode of at least 0.005 and at most 0.15, and by means of a tungsten filling ratio of the thoriated tungsten part of at least 90% the lamp can be provided with an excellent arc stability and an excellent durability.

Then, with the discharge lamp according to the present invention, by means of diffusion-bonding the thoriated tungsten part and the main body part the thoriated tungsten part can be bonded to the main body part with almost no reduction of the thorium oxide ($ThO_2$) contained in the thoriated tungsten part. As by means of diffusion-bonding a bonding at a temperature being lower than the melting point of the tungsten becomes possible, the structures of the thoriated tungsten part and the main body part can be maintained, the performance of the cathode is not influenced, and moreover, there is the benefit that a processing by cutting becomes possible also after the bonding.

DETAILED DESCRIPTION OF THE INVENTION

Figure 1:
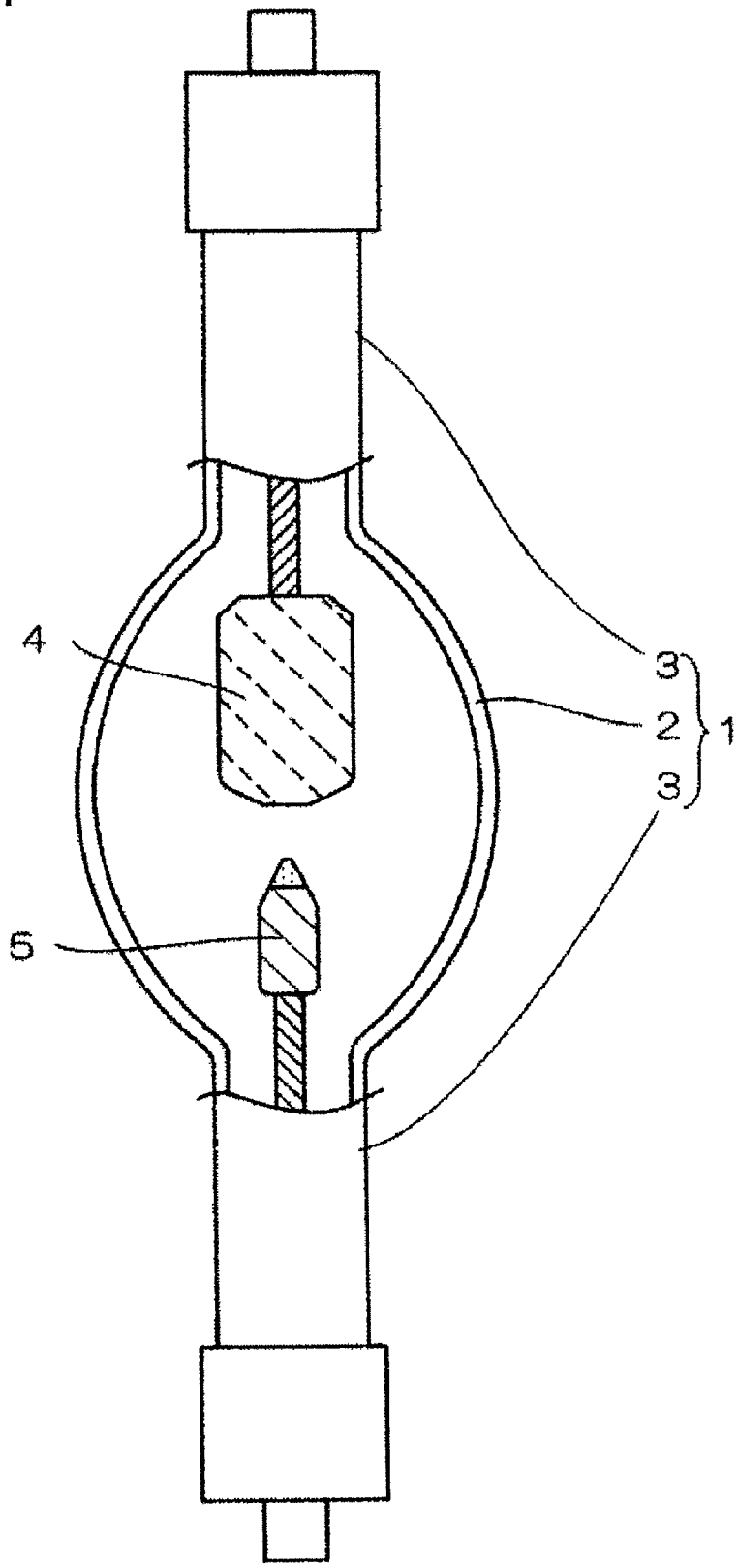
FIG. 1 is an explanatory sectional view showing the configuration of a discharge lamp.

FIG. 1 shows an embodiment of a discharge lamp according to the present invention. To facilitate the explanation, only the internal configuration of the light emitting part 2 of the discharge vessel 1 is shown in this drawing. The internal configuration of the sealing portions 3 is not shown.

The discharge lamp consists of a discharge vessel 1 which is made entirely from quartz glass and comprises an approximately spherical light emitting part 2 and sealing parts 3 formed in continuation with both ends thereof. In the interior of the light emitting part 2 an anode 4 and a cathode 5 are arranged such that they extend along the axial direction of the tube of the discharge vessel 1. The tip ends of both electrodes are arranged opposite to each other via a spacing of some millimeters. In the interior space of the light emitting part 2, a light emitting substance or a gas for the light emission is enclosed. In the case of a high-pressure mercury lamp being the light source of an exposure machine for liquid crystals or semiconductors, mercury (Hg) and xenon (Xe) gas or argon (Ar) gas being a buffer gas are enclosed. In the case of a xenon lamp being the light source of a projector, xenon gas is enclosed. In an example for a high pressure mercury lamp the enclosed amount of mercury is 1 to 70 mg/cm$^3$, and the enclosed amount of xenon gas is 0.08 to 0.5 MPa. The anode 4 is formed entirely from pure tungsten having a tungsten content of at least 99.9 wt. %. The cathode will be explained later.

If a high voltage of, for example, 20 kV is applied between the electrodes in a discharge lamp with such a configuration, a dielectric breakdown occurs between the electrodes, a discharge arc is formed and the lamp lights. In the case of a high-pressure mercury lamp, light with a line spectrum comprising mainly light with an i-line with a wavelength of 365 nm or a g-line with a wavelength of 435 nm is emitted, while in the case of a xenon lamp light with a continuous spectrum with a wavelength from 300 nm to 1100 nm is emitted.

Figure 2:
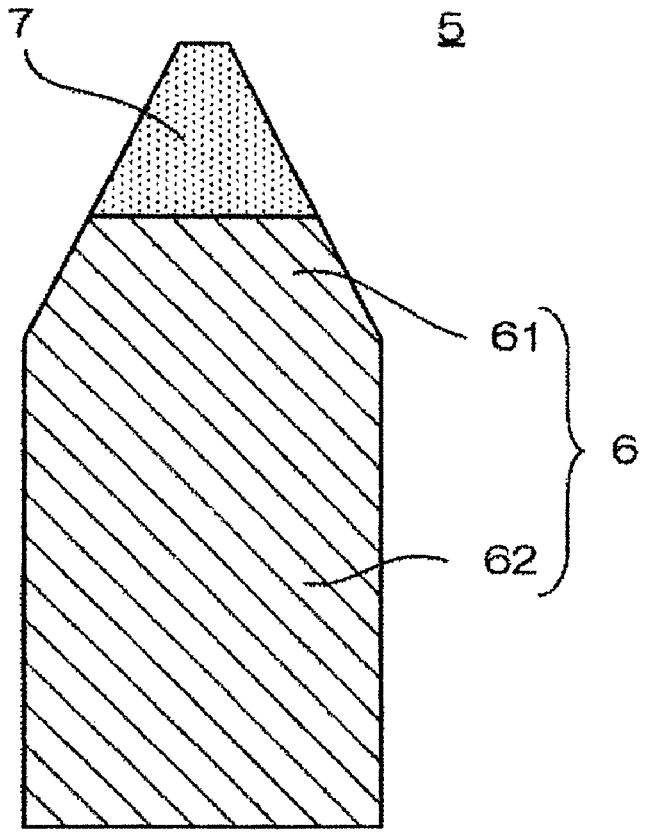
FIG. 2 is an enlarged sectional view along the axial direction of the cathode of the discharge lamp.

FIG. 2 is an enlarged view of the cathode 5 of the discharge lamp shown in FIG. 1, and in particular illustrates the sectional configuration in the longitudinal direction.

The cathode 5 comprises a main body part 6 from pure tungsten and a thoriated tungsten part 7 provided at the tip end of this main body part 6 adjacent to the anode.

The main body part 6 consists of pure tungsten with a tungsten content of at least 99.9 wt. % and is formed integrally from an approximately frustoconical taper part 61 gradually tapering towards the tip end adjacent to the anode and an approximately cylindrical body part 62 following the rear end of this taper part 61.

The thoriated tungsten part 7 has tungsten (W) as a main constituent and contains thorium oxide ($ThO_2$) as an emitter (a material easily emitting electrons), that is, is made from thoriated tungsten ($ThP_2$—W). Concretely, the thorium oxide content amounts to 2 wt. %. The shape of the thoriated tungsten part 7 is entirely frustoconical, and the tip end face of the truncated cone is arranged opposite to the tip end of the anode 4 while the rear end face of the truncated cone is diffusion-bonded to the tip end face of the taper part 61 of the main body part 6. The side face of the thoriated tungsten part 7 has the same inclination as the side face inclination of the taper part 61 of the main body part 6 so that it is continuous, and the frustoconical shape of the cathode tip end is formed entirely by the taper part 61 of the main body part 6 and the thoriated tungsten part 7.

The region of the cathode 5 in which the thoriated tungsten part 7 is present is the area of the formation of the discharge arc or the vicinity thereof, that is, the region directly experiencing the influence of the heat by the arc. Therefore, during the lighting of the lamp the thorium oxide contained in the thoriated tungsten part 7 is reduced and becomes thorium atoms. The thorium atoms diffuse via the interior or the outer surface of the thoriated tungsten part 7 and move to the tip end. Therefore it becomes possible to always supply thorium to the tip end of the cathode 5 although the region in which the thoriated tungsten part 7 is present is limited in the whole cathode to only one region of the tip end. As the result, the work function can be reduced and a cathode with excellent ability to ignite the arc and excellent wear resistance can be achieved.

The thorium contained in the thoriated tungsten part 7 also evaporates by means of the high temperature during the lighting. But the thorium is ionized to thorium ions ($Th^+$) in the arc and is attracted towards the cathode by its own polarity. Because of the repetition of the cycle of the evaporation in the arc, the ionization to thorium ions and the return to the cathode 5, as the result, the consumption of the thorium can be suppressed.

As in the case of the cathode 5 explained by the conventional technology thorium evaporates also from regions other than the tip end of the cathode 5, a large quantity of thorium is formed which does not reach the arc, and therefore the above-mentioned ionization cannot be expected in the same extent. When the thorium adheres to the inner wall of the discharge vessel 1, a clouding occurs, and as the result the emitted light is blocked which leads to a decrease of the irradiance and becomes the cause of a short life. In the present invention the evaporation of thorium not contributing to the above mentioned cycle is reduced by limiting the region of the presence of the thoriated tungsten part 7 only to the tip end part of the cathode 5 and by specifying a ratio for this region with regard to the side surface area of the whole cathode by means of an experiment explained below.

The thorium evaporated from the cathode 5 becomes thorium ions and returns to the cathode 5, as mentioned above. But if the temperature of the cathode 5 has increased excessively, the thorium atoms adhere to the inner surface of the discharge vessel 1 which has a low temperature in the interior of the discharge space, react with the silica ($SiO_2$) being the material which constitutes the discharge vessel 1, and form compounds (clouding). To solve this problem, the present invention suppresses an excessive temperature increase of the cathode tip end by increasing the thermal conductivity of the thoriated tungsten part 7 containing thorium oxide.

Concretely, the thoriated tungsten part 7 has a tungsten filling ratio of at least 90%. Especially with discharge lamps having an input power of 1 kW and more it is necessary to increase the thermal conductivity also from the aspect of withstanding a high thermal load in addition to the above mentioned generation of a clouding. As, precisely, also thorium oxide is contained in the thoriated tungsten part 7, it is necessary to not only consider the thermal conductivity of tungsten but also the thermal conductivity of thorium oxide. But because the thermal conductivity of thorium oxide is much lower as compared to the thermal conductivity of the tungsten, the tungsten filling ratio can be used as an index for the thermal conductivity of the thoriated tungsten part 7. The invention of the present application is characterized by a tungsten filling ratio of the thoriated tungsten part 7 of at least 90%. Because of the high thermal conductivity it can also be referred to as 'highly thermal conductive thoriated tungsten'. The invention of the present application can achieve arc stability and durability by specifying not only the ratio of the thoriated tungsten part 7 in the cathode 5 (the ratio of the side surface area) but also the tungsten filling ratio of the thoriated tungsten part 7. If, therefore, a configuration in which thoriated tungsten is only present in the tip end part of the cathode 5 would already exist, the desired thermal conductivity could not be provided with a low tungsten filling ratio, and as the result, the problems of an excessive evaporation of thorium from the cathode tip end and the clouding of the discharge vessel 1 would be inevitable.

The filling ratio P of tungsten is given by '$P=a(1-x)/19.3$'. The density ($g/cm^3$) of the thoriated tungsten forming the thoriated tungsten part 7 is a, the weight ratio of thorium oxide with regard to the thoriated tungsten is x, and the density ($g/cm^3$) of tungsten is 19.3. $a(1-x)$ is the mass the tungsten occupies in 1 $cm^3$ thoriated tungsten, and the filling ratio P for which the above term is divided by 19.3 ($g/cm^3$) being the density of tungsten stands for the portion of the volume occupied by tungsten in the thoriated tungsten. Because, as was mentioned above, the thermal conductivity of the thoriated tungsten derives nearly totally from tungsten, the thermal conductivity of the thoriated tungsten becomes better with the increase of the portion of the volume occupied by tungsten, that is, the filling ratio P.

Next, one example for the method of producing the cathode 5 of the discharge lamp according to the present invention will be explained.

First, for the main body part 6, a taper part 61 is formed by cutting the side part of cylindrical tungsten. For the thoriated tungsten part 7, a primary molding is formed by inserting mixed powder consisting of emitter powder (thorium oxide powder) and tungsten powder into a metal mold and pressing. This primary molding is sintered. In doing so, the sintered material is subjected to hot forging to increase the filling ratio of the tungsten. Concretely, the sintered material heated to a high temperature is swaged by a hammer or the like. In the condition in which the tungsten filling ratio has reached at least 90%, the sintered body is cut and shaped into a desired form, for example the shape of a truncated cone.

Next, the main body part 6 and the thoriated tungsten 7 are bonded. First the tip end face of the taper part 61 of the main body part 6 and the rear face part becoming the thoriated tungsten part 7 are joined and heated by means of applying an electrical current while they are pressed from the bottom face of the main body part 6 and the top face of the thoriated tungsten part 7. Concretely, the bonding temperature is set to about 50 to 60% of the melting temperature of the material in absolute temperature (K) while the pressing force is set to about 20 to 40% of the yield stress of the material at the bonding temperature in a vacuum of some 10 Pa. This condition is held and the diffusion-bonding is performed until a shrinking amount of about 0.2 to 0.3 mm is obtained.

The 'diffusion-bonding' is a solid-phase bonding method whereby metals are joined at their faces, and are heated and pressed such that no plastic deformation occurs in the solid state below the melting point, and the atoms of the bonded part are diffused.

As with the diffusion-bonding the heating temperature amounts to about 2000° C., and a heating to the melting point of tungsten (approximately 3400° C.) such as with the melt-bonding is not necessary, there is almost no reduction of the thorium oxide ($ThO_2$) contained in the thoriated tungsten part 7. And because the textures of the main body part 6 and the thoriated tungsten part 7 can be maintained, there is also no adverse influence on the efficiency of the cathode. As the texture of the cathode 5 does not change, a processing of the main body part 6 and the thoriated tungsten part 7 by cutting becomes possible also after the bonding.

The fact that the main body part 6 and the thoriated tungsten part 7 of the cathode 5 have been diffusion-bonded can be assessed by confirming that the bonded faces of both have not melted and that the crystal grains of the tungsten have grown and are bonded. Concretely, the bonding faces of the main body part 6 and the thoriated tungsten part 7 are magnified with a microscope. If crystal grains having grown such that they cross the joint of the main body part 6 and the thoriated tungsten part 7 are present, it can be assessed that both have been joined by diffusion-bonding.

Figure 3:
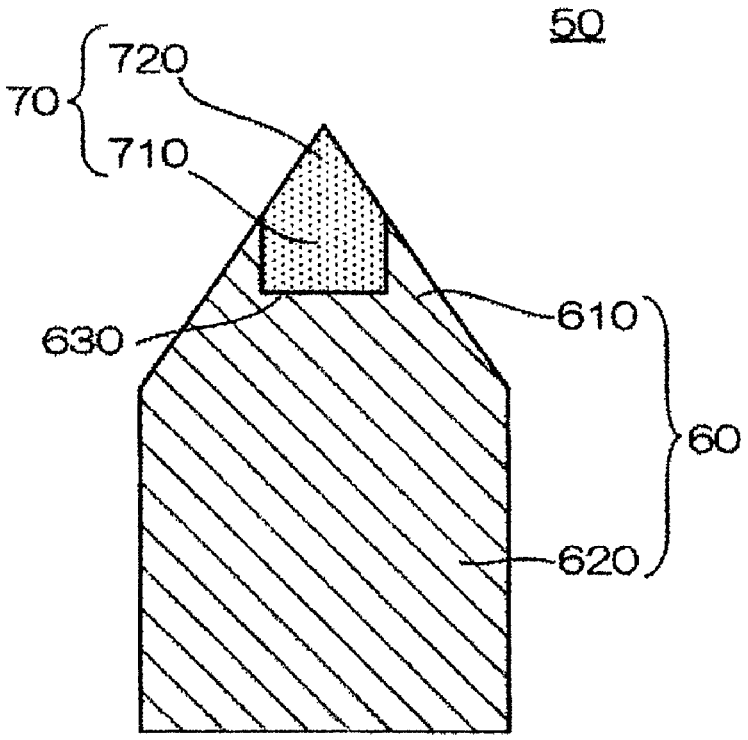
FIG. 3 is an enlarged sectional view along the axial direction of the cathode of the discharge lamp.

FIG. 3 illustrates the configuration of the cathode of a discharge lamp according to the present invention but shows a configuration different from FIG. 1. Concretely, in the case of the cathode 5 shown in FIG. 1 the rear end face (bottom face) of a frustoconical thoriated tungsten part 7 and the tip end face of a main body part 6 from pure tungsten had been bonded at approximately the same diameter, but in the present embodiment the thoriated tungsten part 70 consists of a cylindrical body part 710 and a tip end part 720. The cylindrical body part 710 of the thoriated tungsten part 70 is inserted into a recess 630 of the main body part 60. The tip end of the thoriated tungsten part 70 may be conical such as in the drawing, but may also be frustoconical.

Next, an experiment showing the results of the present invention will be explained.

The irradiance maintenance rate for a discharge lamp according to the present invention with the configuration shown in FIG. 1 was measured while changing the surface area ratio of the side surface area $S_T$ of the thoriated tungsten part and the side surface area S of the cathode. As a lamp for comparison, a discharge lamp in which the entire cathode was made up from thoriated tungsten was used, and also for this lamp the irradiance maintenance rate was measured. The irradiance maintenance rate was measured as the durability until the irradiance dropped to 50% as compared to the initial irradiance while the lamp was continuously lighted. In the lamps used for the experiment only the volume of the thoriated tungsten part as to the cathode was changed while the overall shape and the overall volume of the cathodes were the same. Also the remaining configuration besides the cathode was completely the same.

As the result of the experiment, the durability was approximately the same as in the case of the lamp for comparison, when the surface area ratio $S_T/S$ of the side surface area $S_T$ of the thoriated tungsten part and the side surface area S of the cathode exceeded 0.15 When the surface area ratio $S_T/S$ of the side surface area $S_T$ of the thoriated tungsten part and the side surface area S of the cathode was 0.15 and below, the durability of the discharge lamp of the present invention was longer than that of the lamp for comparison.

When the ratio $S_T/S$ was smaller than 0.005, the arc became extremely instable. It is presumed that this is because the thorium amount is low.

As the result it was confirmed that a surface area ratio $S_T/S$ of the surface area $S_T$ of the thoriated tungsten part and the surface area S of the cathode in a range of 0.005 to 0.15 is effective at least for a better durability and a better stability of the arc than with known lamps.

The specifications in the present invention can be assessed, substantially, by the surface area of the side surface such as the side surface area of the thoriated tungsten part and the side surface area of the cathode. But because the tip end shape of the thoriated tungsten part changes with the progress of the lighting time and the boundary between the side surface and the tip end face becomes unclear, in the present invention also the surface area of the tip end is included in the side surface area of the thoriated tungsten part.

The above-mentioned experiment was performed for a xenon lamp, but when the same experiment was performed for a high-pressure mercury lamp, the same results with regard to the improvement of the durability and the stability of the arc as compared to a known lamp, that is, a cathode consisting entirely of thoriated tungsten, were confirmed for the high-pressure mercury lamp when the surface area ratio $S_T/S$ of the side surface area $S_T$ of the thoriated tungsten part and the side surface area S of the cathode amounted to 0.005 to 0.15.

For the known discharge lamp, the thoriated tungsten concentration of the cathode surface was observed using an energy dispersive X-ray spectroscope for a new discharge lamp having only lighted for a short time and a discharge lamp in its final stage after having lighted for a long time. As the result, the thorium concentration had decreased for the latter discharge lamp up to a length of approximately twice the diameter of the body part of the cathode, that is, the thorium had evaporated, but for the length beyond twice the diameter it was confirmed that the thorium concentration had remained practically unchanged in comparison to the new discharge lamp. From this fact it was confirmed that the evaporation of the thorium in the cathode occurs in the region up to twice the diameter of the body part of the cathode. That means that also for the surface area ratio $S_T/S$, the side surface area S of the cathode shall be confined to a length of up to twice the diameter of the body part of the cathode.

Figure 4A:
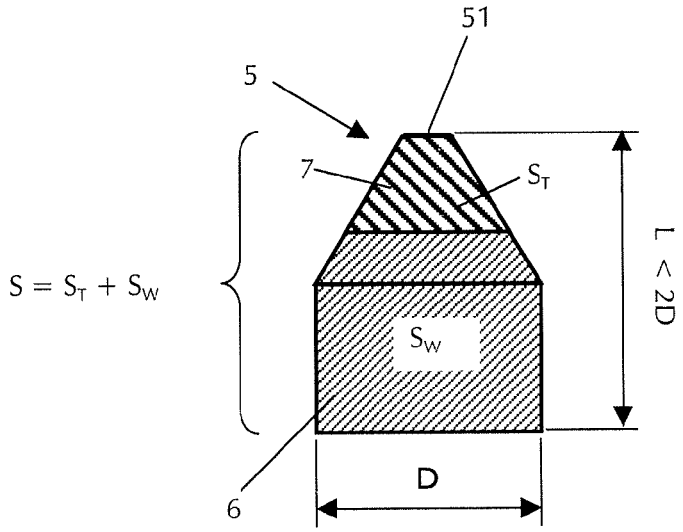
FIGS. 4(*a*) and 4(*b*) are schematic views of a cathode illustrating the side surface areas used for calculating the ratio $S_T/S$.
Figure 4B:
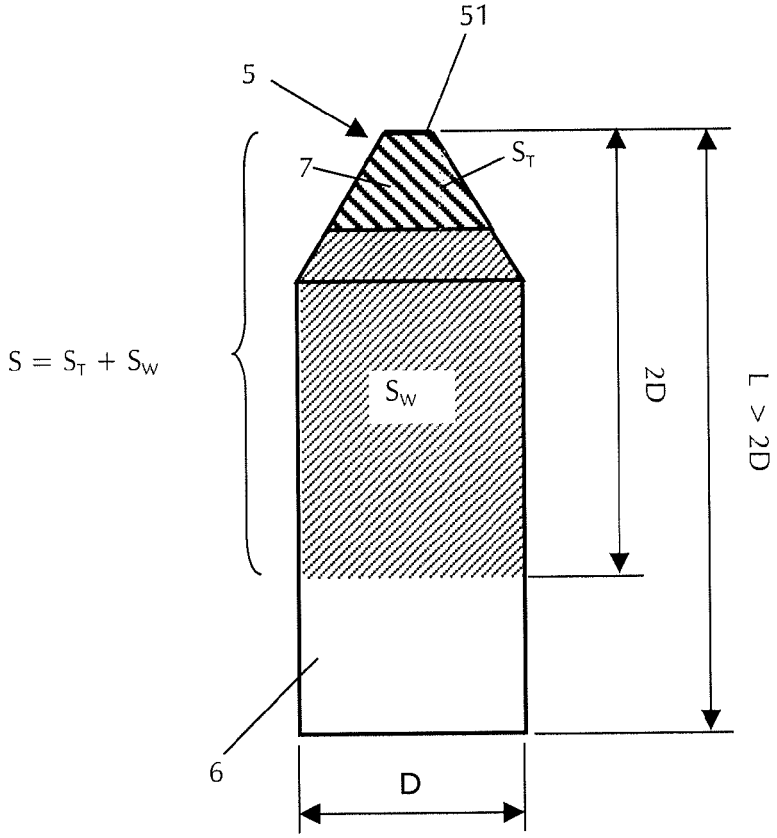

The side surface areas S and $S_T$ are shown in FIGS. 4(*a*) and 4(*b*). FIG. 4(*a*) shows a cathode 5 having a relatively short length L. The length L is the distance in the direction of the cathode axis from the cathode tip 51 to the end of the cathode opposite the tip. In case of the cathode 5 of FIG. 4(*a*) the length L is smaller than twice the maximum diameter D of the cathode. In accordance with the invention, the cathode 5 comprises a thoriated tungsten part 7 and a main body part 6 made of pure tungsten. The side surface area of the thoriated tungsten part is $S_T$ and indicated by the bold hatching. The surface area $S_T$ comprises the lateral surface area of the thoriated tungsten part 7 as well as the circular surface area of the cathode tip 51. The side surface area of the main body part 6 is shown in thin hatching and is denoted $S_W$. In the present case, it comprises the lateral surface area starting from the thoriated tungsten part up to the back end of the cathode 5. The surface area S of the cathode 5 consists of the side surface area $S_T$ of the thoriated tungsten part plus the side surface area $S_w$ of the main body part 6.

FIG. 4(*b*) shows a cathode 5 of a relatively great length L. Here, the length L is more than twice the maximum diameter D of the cathode 5. While the side surface area $S_T$ of the thoriated tungsten part 7 principally corresponds to that of a shorter cathode as shown in FIG. 4(*a*) the side surface area S of the cathode 5 used for calculating the ratio $S_T/S$ does not correspond to the surface area of the whole main body part 6. As mentioned in paragraph [0037] above, the tungsten concentration practically remains unchanged in that part of the main body 6 which lies beyond twice the maximum diameter D of the cathode. Consequently, this back end part of the cathode 5 need not be considered in calculating the ratio $S_T/S$. Therefore, the side surface area S used in the calculation is confined to a maximum value which corresponds to the side surface area S which corresponds to a length L of twice the maximum cathode diameter D. That is, only the side surface areas $S_T$ and $S_w$ indicated by the hatchings in FIG. 4(*b*) are used for calculating the ratio $S_T/S$.

What is claimed is:

1. A discharge lamp wherein an anode and a cathode are present in the interior of a discharge vessel, wherein said cathode is made up from a thoriated tungsten part with a tungsten filling ratio of at least 90 vol.-% and a main body part connected to said thoriated tungsten part and consisting of pure tungsten, wherein a ratio $S_T/S$ of a side surface area $S_T$ of said thoriated tungsten part and a side surface area S of said cathode is in a range of from 0.005 to 0.15, with the proviso that, in case the cathode has a length in the direction of the cathode axis which exceeds twice the maximum diameter of the cathode, a side surface area S is used for calculating the ratio $S_T/S$ which corresponds to the side surface area where the distance along the cathode axis from a tip end adjacent to the anode is twice the maximum diameter of the cathode.

2. The discharge lamp according to claim 1, wherein said thoriated tungsten part and said main body part are diffusion-bonded.

3. The discharge lamp according to claim 1, wherein said thoriated tungsten part is a frustoconically truncated cone on a tip end of the main body part, and wherein a tip end face of the truncated cone is arranged facing opposite a tip end of the anode.

4. The discharge lamp according to claim 3, wherein side faces of said thoriated tungsten part have the same inclination as a side face inclination of a taper part of the main body part so as for form a continuous surface.

5. The discharge lamp according to claim 1, wherein the thoriated tungsten part comprises a cylindrical body part that is disposed in a recess in a tip end of the main body and tip end part which projects from said recess and is arranged facing opposite a tip end of the anode.

6. The discharge lamp according to claim 1, wherein the tip end part of the thoriated tungsten part is conical or frustoconical.

7. The discharge lamp according to claim 6, wherein the tip end part of the thoriated tungsten part has side faces with the same inclination as a side face inclination of a tapered part of the main body part so as for form a continuous surface therewith.

* * * * *